United States Patent [19]

Hanson

[11] 4,278,003

[45] Jul. 14, 1981

[54] PEDAL ADJUSTABLE DRUM

[75] Inventor: Donald L. Hanson, Sylmar, Calif.

[73] Assignee: Remo Inc., North Hollywood, Calif.

[21] Appl. No.: 67,747

[22] Filed: Aug. 20, 1979

[51] Int. Cl.[3] ..... G10D 13/02

[52] U.S. Cl. ..... 84/411 A; 84/419; 84/421

[58] Field of Search ..... 84/411 A, 411 R, 422 H, 84/422 R, 421, 419, 415

[56] References Cited

U.S. PATENT DOCUMENTS

| | | | |
|---|---|---|---|
| 1,356,198 | 10/1920 | Danly | 84/419 |
| 1,458,905 | 6/1923 | Leedy | 84/415 |
| 1,561,789 | 11/1925 | Ludwig et al. | 84/419 |
| 1,722,032 | 7/1929 | Bower | 84/415 |
| 1,755,569 | 4/1930 | Strupe | 84/419 |
| 1,845,625 | 2/1932 | Robison | 84/419 |
| 1,853,466 | 4/1932 | Sigler | 84/415 |
| 1,892,223 | 12/1932 | Sansone et al. | 84/419 |
| 2,074,194 | 3/1937 | Strupe | 84/419 |
| 2,198,406 | 4/1940 | Deans | 84/419 |
| 2,205,593 | 6/1940 | Jeffries | 84/419 |
| 2,261,119 | 11/1941 | Ludwig et al. | 84/421 |
| 2,548,271 | 4/1951 | Percy | 84/422 R |
| 2,564,933 | 8/1951 | Somerville | 84/411 |
| 3,021,743 | 2/1962 | Ludwig | 84/419 |
| 3,163,075 | 12/1964 | Toperzer | 84/419 |
| 3,215,021 | 11/1965 | Kester | 84/411 |
| 3,279,299 | 10/1966 | Murbach | 84/419 |
| 3,685,389 | 8/1972 | Bemben | 84/411 |
| 3,701,834 | 10/1972 | Rubio | 84/419 |
| 3,747,463 | 7/1973 | Hinger | 84/419 |
| 3,797,356 | 3/1974 | Duffy et al. | 84/422 |

FOREIGN PATENT DOCUMENTS

| | | | |
|---|---|---|---|
| 590803 | 8/1947 | United Kingdom | 84/419 |

OTHER PUBLICATIONS

Ludwig Catalog No. 75-1, Published by Ludwig Drum Company, 1974, p. 55.

Slingerland Catalog 69, Published by Slingerland Drum Company, 1968, p. 40, "The Ball-Bearing Clutch".

*Primary Examiner*—L. T. Hix

*Assistant Examiner*—Alan Mathews

*Attorney, Agent, or Firm*—Lyon & Lyon

[57] ABSTRACT

A drum is adjustable in pitch by a pedal assembly connected by a wire cable to an actuating lever. The lever causes pressure to be exerted against a tension-adjusting ring over which the drumhead is stretched. The pedal may be locked in any selected position to maintain the desired pitch, and the height of the drum is adjustable without adjustment of the cable linkage. A drum which is adjustable in pitch by rotation of the drum shell can thus be made adjustable by use of a pedal as well. The assembly for exerting pressure against the tension-adjusting ring is designed to be retro-fitted to certain types of existing drums to permit use therewith without the need for extensive modifications.

23 Claims, 11 Drawing Figures

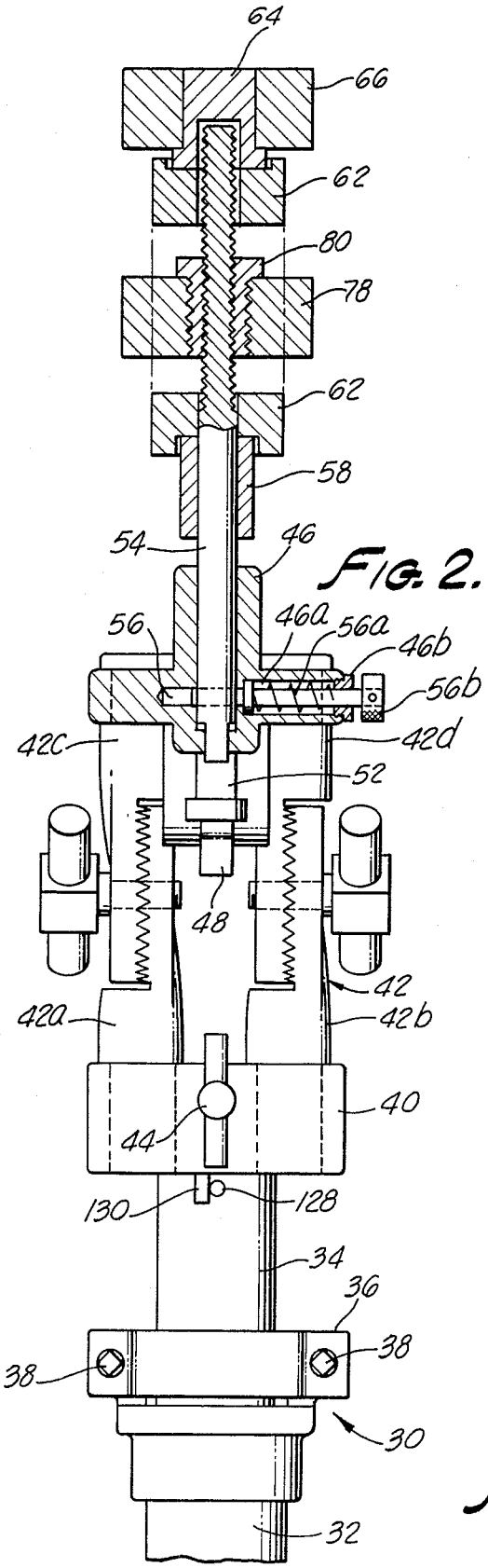
FIG. 2.
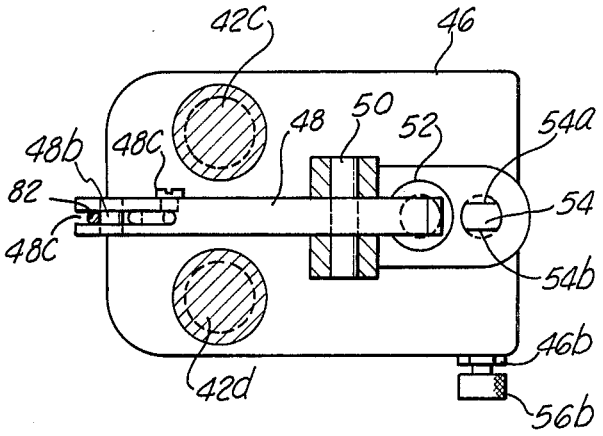
FIG. 3.
FIG. 4.
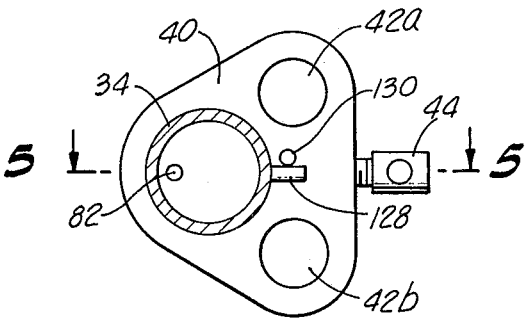
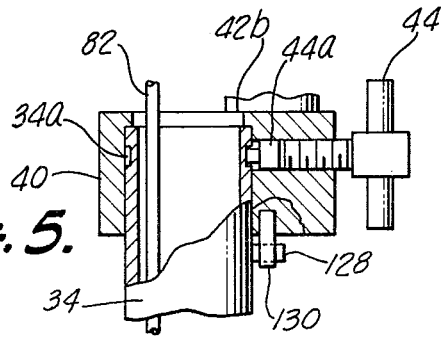
FIG. 5.

FIG. 10.
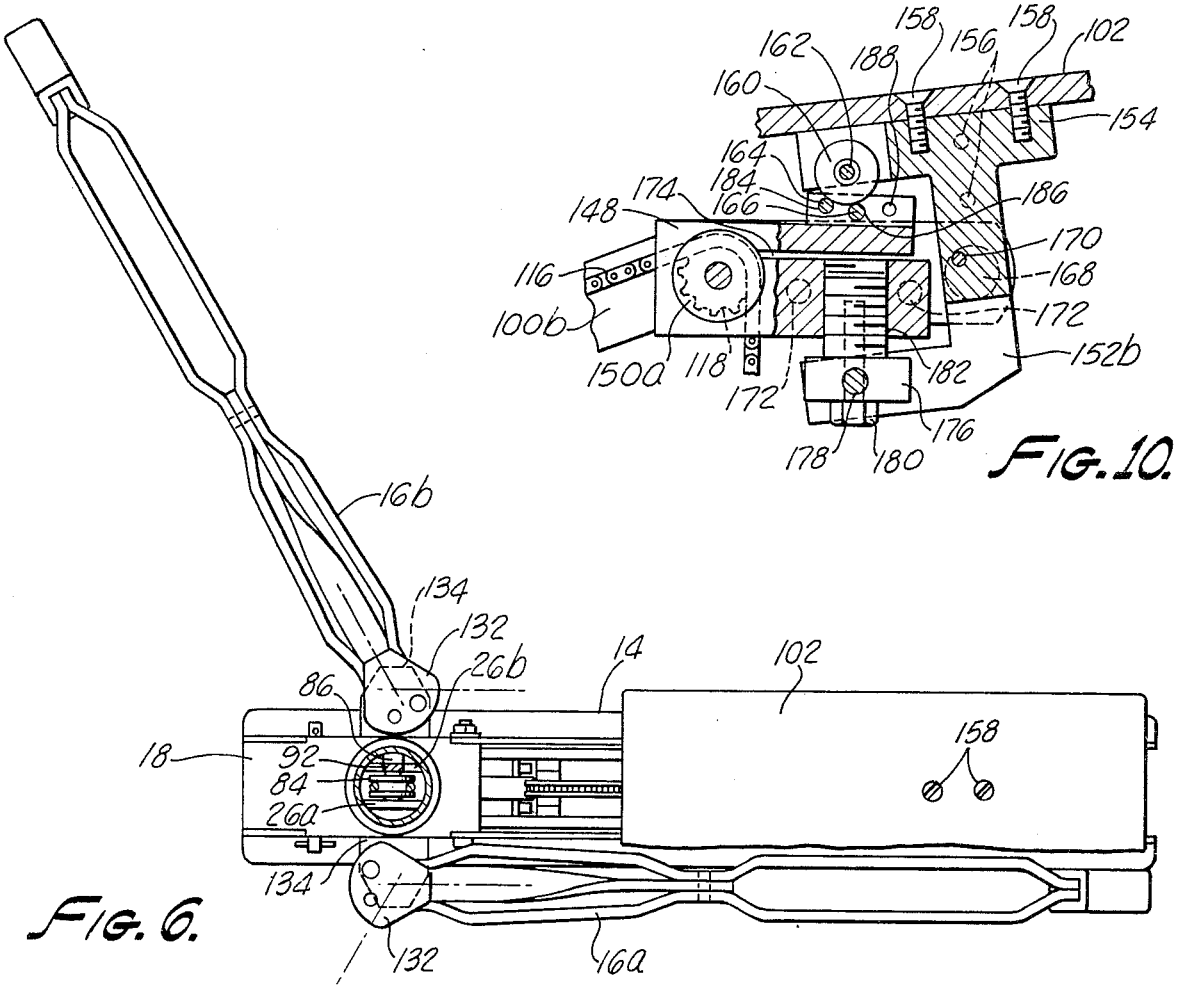
FIG. 6.
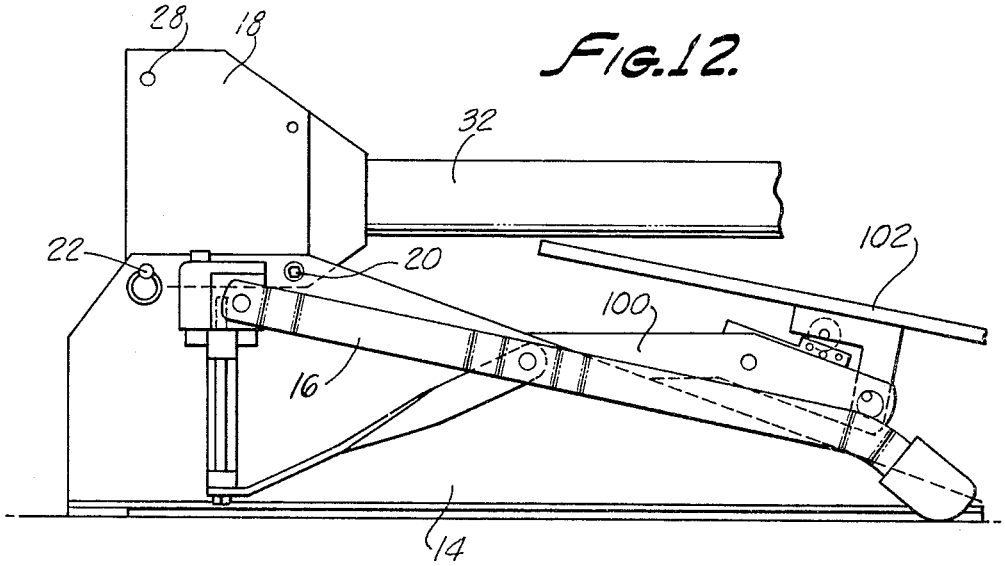
FIG. 12.

PEDAL ADJUSTABLE DRUM

BACKGROUND OF THE INVENTION

The present invention relates to drums, and more particularly to drums whose pitch is adjustable by rotation of the drum shell and/or activation of a pedal connected to drumhead-tensioning apparatus.

It is well known in the art to adjust the pitch of a drum by varying the tension on the drumhead. Devices for achieving this function have typically been used in conjunction with tympani, and have consisted of assemblies whereby activation of a pedal stretches the drumhead to increase the pitch. Tympani are also known which are adjustable in pitch by rotation of the drum shell about a central support axis. While combined pitch adjustability by rotation as well as by a pedal arrangement has been found in the prior art, the pedal-adjustable feature of such drums has typically required a large, heavy, cumbersome apparatus which is not separable from the drum itself. Also, the height of such drums above the floor or other surface has not been readily adjustable.

Another type of drum whose pitch may be varied by rotation is a drum which has been manufactured and sold for a number of years by the assignee of the present application under the trademark "RotoTom". A "RotoTom" drum has a drumhead stretched over an upper die casting or "spider" and held by a counter hoop. The upper die casting has a central hub against which abuts a threaded shaft. Threaded upon the threaded shaft is a lower die casting or spider rigidly affixed to the counter hoop. Rotation of the lower die casting about the threaded shaft causes the force exerted on the drumhead by the upper die casting to vary, thus changing the pitch of the RotoTom drum.

No means has yet been made commercially available for adjusting the pitch of a RotoTom drum by means of a pedal. It has been suggested to design a pedal-adjustable RotoTom drum by drilling the central shaft of the drum and inserting a push rod therethrough, the push rod to be activated by a pedal attached to a cable. Such a design is described in the application of Robert J. Henrit, Ser. No. 67,737 filed concurrently herewith and assigned to the assignee of the present application. However, such an arrangement cannot be easily retrofitted to existing RotoTom drums, because of the necessity of drilling the central shaft of the drum. Also, the suggested design makes no provision for locking the pedal or for convenient height adjustability.

SUMMARY OF THE INVENTION

According to the present invention there is provided an apparatus for adjusting the pitch of a "RotoTom" drum or similar drum by means of a pedal connected by a cable to an actuating mechanism. The height of the drum is adjustable, and the tension of the drumhead can be fixed to maintain any desired pitch by locking the pedal. The apparatus can be retro-fitted to existing RotoTom drums without the need for substantial modifications.

Accordingly, it is an object of the present invention to provide an improved pedal-adjustable drum.

It is a further object of the present invention to provide a pedal-adjustable drum whose height above a floor or other surface can easily be varied.

It is another object of the present invention to provide an apparatus for pedal adjustment of a RotoTom drum which is adapted to be used with presently existing units.

These and other objects and advantages of the present invention will become apparent from the following detailed description, taken in conjunction with the accompanying drawings.

BRIEF DESCRIPTION OF THE DRAWINGS

FIG. 2 is a partial cross-sectional view taken along the line 2—2 of FIG. 1 showing detail of the drum support and drumhead tensioning mechanism.

FIG. 3 is a partial cross-sectional view of the drum support apparatus and actuating lever, taken along the line 3—3 of FIG. 1.

FIG. 4 is a cross-sectional view of the support column showing the mounting bracket carried thereby, taken along the line 4—4 of FIG. 1.

FIG. 5 is a partial cross-sectional view showing detail of the mounting bracket of FIG. 4, taken generally along the line 5—5 of FIG. 4.

FIG. 6 is a view in partial cross-section taken along the line 6—6 of FIG. 1, showing the support stand assembly.

FIG. 10 is a partial side elevation as in FIG. 1, showing detail of the pedal locking mechanism.

DETAILED DESCRIPTION OF THE INVENTION

Figure 1:
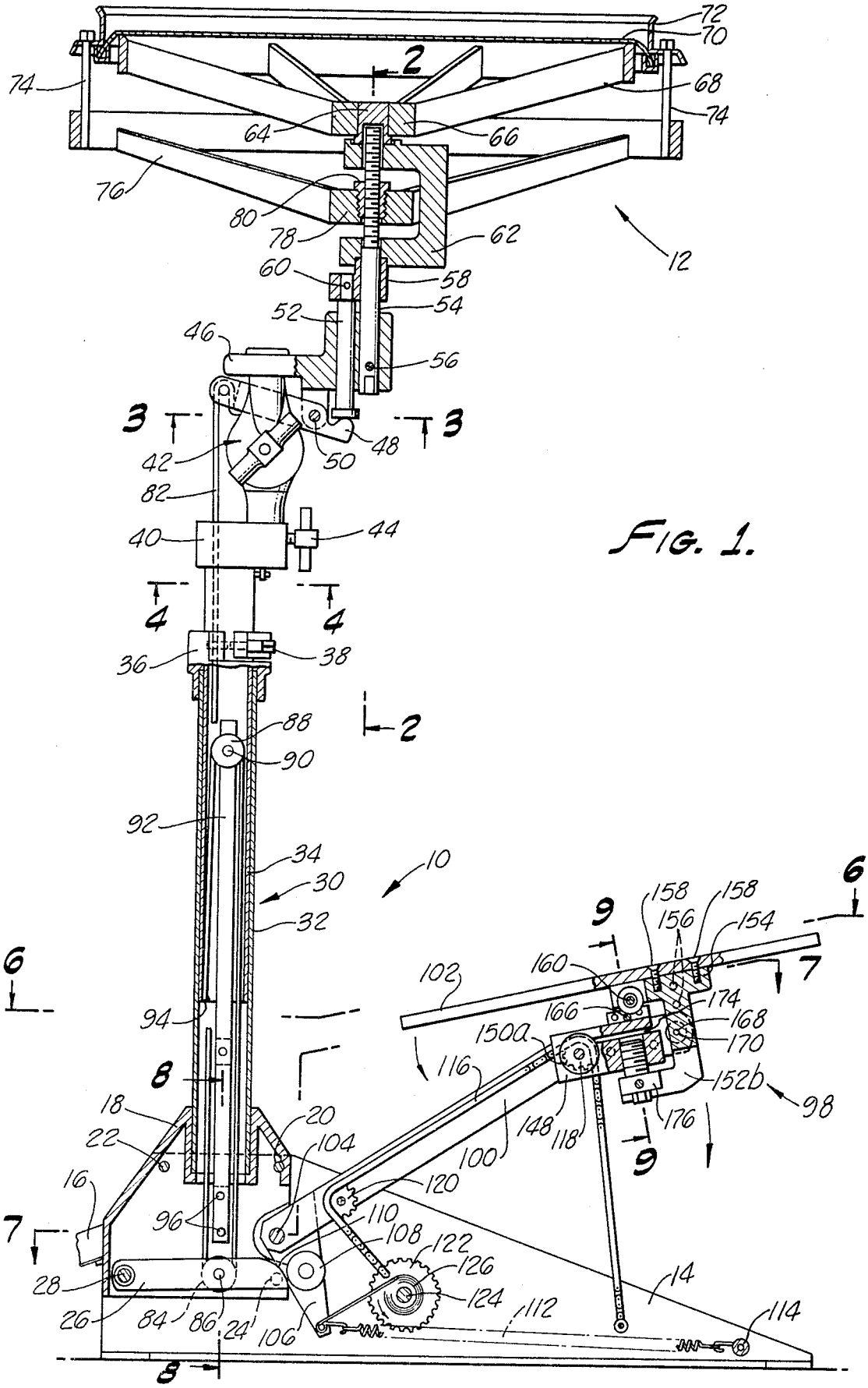
FIG. 1 is a side elevation, in partial cross-section and with certain features removed for clarity, of a drum stand incorporating a pedal adjustment mechanism according to the present invention, showing a RotoTom drum supported thereon.

Referring first to FIG. 1, there is illustrated a side elevation of a drum stand assembly 10 incorporating the present invention, shown with a "RotoTom" drum 12 mounted thereon. The stand assembly 10 includes a base 14, one side of which has been removed in FIG. 1, and legs 16 (shown in partial view only), which provides stability to the stand assembly 10 and which may be folded up for convenient storage as explained in greater detail hereinafter.

A support block 18 is fastened to the base 14 by a fastener 20 and a removable pin 22 which extends through coincident apertures in the support block 18 and in the base 14. An aperture 24, whose function will be explained hereinafter, is also provided in the support block 18. A toggle linkage arm 26, whose function will also be described hereinafter, is attached to the support block by a fastener 28, about which the toggle linkage arm 26 may pivot.

A telescoping rod assembly 30 is supported by the support block 18, and comprises, in the illustrated embodiment, a lower support column 32 and an upper support column 34 slidably received therein. A clamp 36 mounted upon the upper end of the lower support column 32 is provided with tightening means 38 such as bolts for clamping the upper support column 34 in any desired position within the lower support column 32. At the upper end of the upper support column 34 is a clamp 40 which carries a ratchet 42. A wing screw 44 may be provided to tighten the clamp 40 onto the upper support column 34.

Mounted upon the ratchet 42 is a support block 46 which carries an actuating lever 48 pivoted about a pin 50. One end of the lever 48 is in contact with an actuating pin 52 which extends through the support block 46. A guide stud 54 also extends through the support block 46, and is fixedly connected thereto by a pin 56. Approximately the upper half of the guide stud 54 is threaded for reasons which will appear hereinafter.

The actuating pin 52 is connected to a force transfer block 58 by a pin 60. The force transfer block 58 supports a "C" bracket 62, and the guide stud 54 extends through both the force transfer block 58 and the ends of the "C" bracket 62. The upper end of the guide stud 54 is received within a blind insert 64 in the central hub 66 of the upper die casting 68 of the RotoTom drum 12, and the blind insert 64 has an annular flange abutting the lower surface of the hub 66. The drumhead 70 is stretched over the upper die casting 68 and is held by a counter hoop 72. Fasteners 74 rigidly connect the counter hoop 72 to a lower die casting 76 of the RotoTom drum 12, and the guide stud 54 is threadably engaged with the central hub 78 of the lower die casting 76 by means of a threaded insert 80. Thus it will be seen that the guide stud 54 replaces the central threaded shaft of a standard RotoTom drum, the threaded insert 80 and the "C" bracket 62 being mounted as shown and described at the time the replacement is made.

A wire cable 82 is attached to the end of the actuating lever 48 opposite the end thereof which is in contact with the actuating pin 52. The cable 82 extends within the telescoping rod assembly 30, around a first pulley 84 which is connected to the toggle linkage arm 26 by a pin 86, around a second pulley 88 which is connected by a pin 90 to a support rod 92 within the telescoping rod assembly 30, and then is fastened to the lower end of the upper support column 34 at a fastening point 94. The support rod 92 is supported within the telescoping rod assembly 30 by being attached to the support block 18 by fasteners 96. In order to illustrate the fastening point 94, a portion of the cable 82 between the lever 48 and the first pulley 84 has been broken away in FIG. 1.

A pedal mechanism 98 is also mounted on the base 14, and comprises a pedal support arm 100 carrying a pedal tread plate 102, and fastened to the base 14 by a fastener 104 about which the pedal support arm 100 may pivot. Also connected to the pedal support arm 100 by the fastener 104 is a toggle arm 106 which carries a cam roller 108 engaged with a curved cam surface 110 of the toggle linkage arm 26. A pedal return spring 112 is connected to the toggle arm 106 opposite its point of connection to the pedal support arm 100, the other end of the spring 112 being connected to the base 14 by a fastener 114.

A roller chain 116 is connected at one end thereof to the base 14, thereafter passing over a first sprocket 118 and a second sprocket 120, both sprockets being mounted on the pedal support arm 100, and terminating at a take-up sprocket 122 connected by a pin 124 to the base 14. The take-up sprocket 122 is tensioned by a coil spring 126 attached to the toggle arm 106 at the same point at which the pedal return spring 112 is attached.

A description of other elements of the present invention which are illustrated in FIG. 1, particularly the pedal brake mechanism carried by the pedal support arm 100, will be provided in connection with more detailed figures to be described hereinafter.

Referring next to FIG. 2, there is illustrated detail of the apparatus for supporting the drum and for tensioning the drumhead thereof. As shown in FIG. 2, the clamp 36 mounted on the upper end of the lower support column 32 is preferably tightened onto the upper support column 34 to maintain the relative position thereof with respect to the lower support column 32 by a pair of bolts 38. The height of the telescoping rod assembly 30 is fully adjustable by loosening the bolts 38, repositioning the upper support column 34 within the lower support column 32, and then retightening the bolts 38. Because of the pulley arrangement described in connection with FIG. 1, the relative position of the support columns is fully adjustable without the need to reposition or adjust the cable 82.

The clamp 40 at the upper end of the upper support column 34 has the feature of being able to rotate about the upper support column 34 upon loosening the wing screw 44, thus permitting the drum to be rotated with respect to the stand assembly 10. A horizontal pin 128 extends out of the upper support column 34 just below the clamp 40, and is adapted to encounter a vertical pin 130 extending downward from the clamp 40 to prevent the clamp 40 from being rotated about the upper support column 34 more than 360°. This prevents the cable 82 from becoming unduly twisted within the telescoping rod assembly 30.

FIG. 2 further illustrates that the ratchet 42 is preferably mounted in the clamp 40 by a pair of legs 42*a* and 42*b*. Similarly, the ratchet 42 preferably has a pair of upwardly extending arms 42*c* and 42*d* which carry the support block 46. The ratchet 42 is adjustable in the standard manner to permit the drum to be presented to the drummer at any desired angular orientation.

The guide stud 54 is preferably engaged with the support block 46 by the pin 56 in a manner which insures a positive connection therebetween. Specifically, the pin 56 is preferably received within a cavity 46*a* of the support block 46, and is maintained in position by a spring 56*a* compressed in the cavity 46*a* by an outer plug 46*b*. A knob 56*b* allows the pin 56 to be withdrawn from the guide stud 54, in order to disengage the guide stud 54 from the support block 46.

The remaining features of FIG. 2 were also illustrated in connection with FIG. 1.

Referring next to FIG. 3, further details of the support block 46 are provided as viewed from the underside thereof. More specifically, FIG. 3 illustrates the arms 42*c* and 42*d* of the ratchet 42 received within the support block 46, and the plug 46*b* and knob 56*b* used to maintain the position of the pin 56 through the guide stud 54. Also, FIG. 3 illustrates the actuating lever 48 held in place by the pin 50. Furthermore, FIG. 3 as well as FIG. 2 illustrates that the lower end of the guide stud 54 is preferably provided with flats 54*a* and 54*b* for mating with similarly flat surfaces in the aperture in the support block 46 in which the guide stud 54 is received, in order properly to orient the guide stud 54 with respect to the support block 46 to permit the insertion of the pin 56 therethrough.

Finally, FIG. 3 illustrates the preferred method of attaching the cable 82 to the actuating lever 48, although many other methods of attachment which would serve the same function will be apparent to those skilled in the art. In the design illustrated in FIG. 3, the cable 82 passes through an aperture 48*a* in the actuating lever 48, thence around a pin 48*b*, and finally is held in place by a screw 48*c* tightened thereagainst.

FIGS. 4 and 5 taken in conjunction provide further detail of the clamp 40 mounted upon the upper end of the upper support column 34. FIG. 4 illustrates the legs 42*a* and 42*b* of the ratchet 42 received within the clamp 40, and the pins 128 and 130 preventing rotation of the clamp 40 more than 360° about the column 34. FIG. 5 shows that a groove 34*a* is formed near the upper end of the column 34, with a dog 44*a* held therein by the wing screw 44 to prevent the possibility of slippage between the column 34 and the clamp 40.

In FIG. 6 there is illustrated a top view of the lower support column 32 and the support block 18 within which the column 32 is received. Also illustrated is the lower pulley 84 connected by the pin 86 to the toggle linkage arm 26, which is preferably formed in two sections 26*a* and 26*b*. The support rod 92 which supports the upper pulley 88 (not shown) is also illustrated in FIG. 6.

FIG. 6 also illustrates the legs 16 mounted on the base 14, and more specifically shows a leg 16*a* folded up parallel to the base 14 and a leg 16*b* in its extended position for support of the drum stand assembly 10. Each of the legs 16 has a hub 132 connected to a lug 134 mounted on the base 14, and further detail of the manner of connection thereof, as well as of the other features shown in FIG. 6, is best described with respect to the detailed cross-sectional view of FIG. 7.

Figure 7:
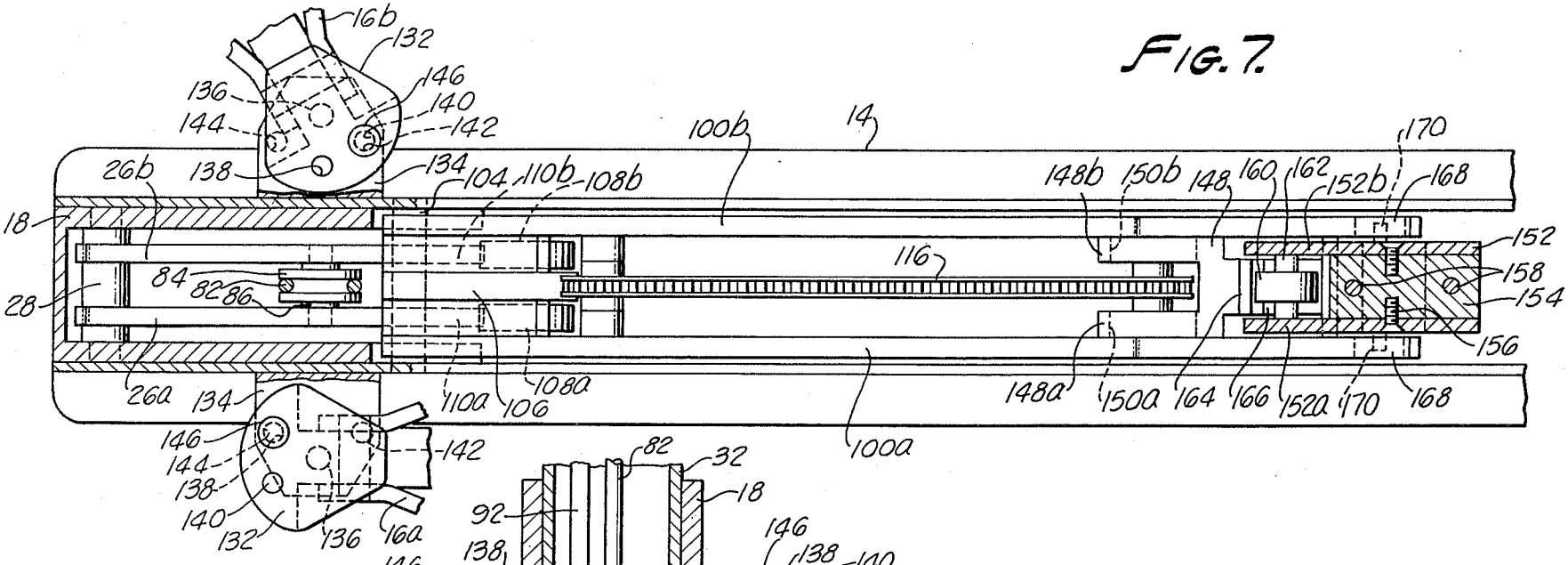
FIG. 7 is a detailed cross-sectional view taken along the line 7—7 of FIG. 1, showing the pedal assembly and related structure.

Referring to FIG. 7, and first to the hubs 132 of the legs 16, each of the hubs 132 is mounted upon a respective lug 134 by a central pin 136, about which the legs 16 pivot. Each of the hubs 132 further contains a pair of cylindrical apertures 138 and 140 which are drilled on a common radius from the pin 136, and each of the lugs 134 contains similar cylindrical apertures 142 and 144 drilled on the same radius. Pins 146 are adapted to extend through these various apertures when the apertures are coincident. More specifically, when the leg 16*a* is folded up parallel to the base 14 as shown in FIG. 7, the apertures 138 and 144 are coincident. Engagement of the pin 146 through these apertures locks the leg 16*a* in the folded position. Removal of the pin 146 permits the leg to be extended, as shown in connection with the leg 16*b*. When the leg has reached its fully extended position, the apertures 140 and 142, shown in FIG. 7 in connection with the leg 16*b*, become coincident, and insertion of the pin 146 therethrough locks the leg in the extended position.

Referring to the remainder of FIG. 7, there is illustrated detail of the apparatus providing interaction between the drumhead tensioning mechanism and the pedal assembly. More specifically, FIG. 7 illustrates that the pedal support arm 100 is formed in two sections, 100*a* and 100*b*, the section denoted 100*a* having been removed in FIG. 1 for purposes of clarity. The sections 100*a* and 100*b* are fastened to the base 14 by the pin 104, by which the toggle arm 106 is also connected thereto. Dual rollers 108*a* and 108*b* are provided, which are connected to the toggle arm 106 and which rest upon the curved cam surfaces 110*a* and 110*b* respectively of the toggle linkage arm portions 26*a* and 26*b*.

At the opposite end of the pedal support arm 100, and more specifically between the sections 100*a* and 100*b* thereof, there is mounted a brake support block 148. The sprocket 118 (not visible in FIG. 7) is received within a recess thereof formed by outwardly extending arms 148*a* and 148*b*, and in the said arms there are formed cylindrical apertures within which brake drums 150*a* and 150*b* are received, the brake drums being mounted on the same axis as the sprocket 118 and rotating therewith when the brake is "unlocked". A "C" shaped bracket 152 surrounds the brake support block 148 on three sides, and comprises two sections 152*a* and 152*b* separated by a "T" shaped member 154 fastened thereto by fasteners 156. The "T" shaped member 154 carries the pedal tread plate 102, which is affixed thereto by fasteners 158. The sections 152*a* and 152*b* of the bracket 152 which are disposed above the brake support block 148 carry a roller 160 mounted on an axis 162. Pins 164 and 166 are carried by the brake support block 148 and are adapted to engage the roller 160 in a manner to be described in greater detail hereinafter. Cylindrical apertures 168 are formed in each section 100*a* and 100*b* of the pedal support arm 100 near the outer extremity thereof, and pins 170 mounted on either side of the bracket 152 are received therein, for purposes which will be explained hereinafter.

Figure 8:
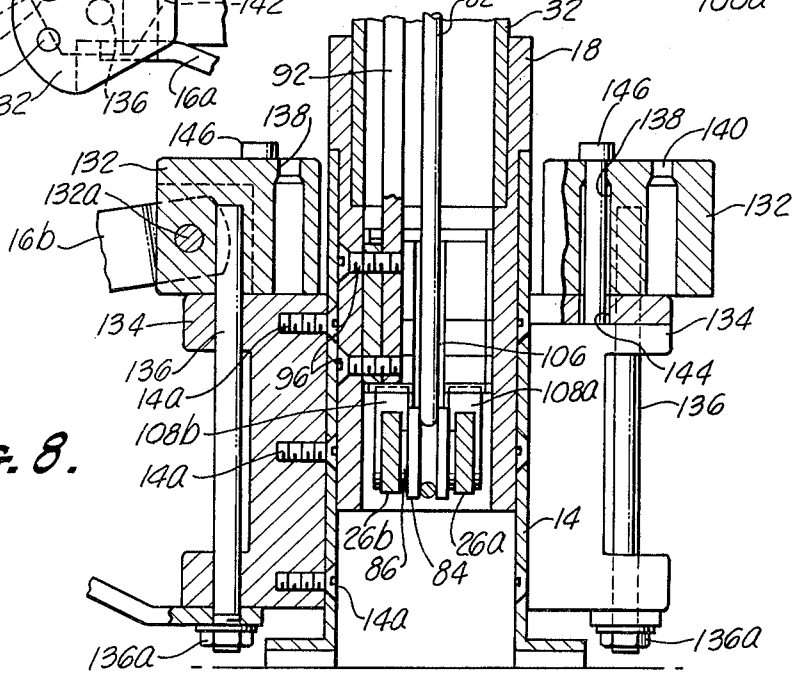
FIG. 8 is a cross-sectional view taken along the line 8—8 of FIG. 1, showing detail of the cable tensioning assembly.

FIG. 8 illustrates a further view of certain of the features shown in FIGS. 6 and 7, in a cross-section taken along the line 8—8 of FIG. 1. In FIG. 8 are illustrated the fasteners 96 by which the support rod 92 is affixed to the support block 18, as well as fasteners 14*a* connecting the lugs 134 to the base 14. The pins 136 are held by fasteners 136*a* and extend through the lugs 134 and into the hubs 132. The legs 16 are affixed to the hubs 132 by pins 132*a*.

Figure 9:
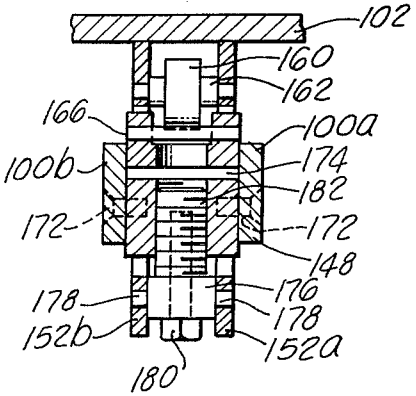
FIG. 9 is a detailed cross-sectional view of the pedal locking assembly, taken generally along the line 9—9 of FIG. 1.

Another view of the brake support block 148 and "C" shaped bracket 152 is provided in FIG. 9. There it is illustrated that the brake support block 148 is mounted to the pedal support arm 100 by fasteners 172, and that there is formed in the brake support block 148 a narrow longitudinal aperture 174 whose function will be described in detail hereinafter. Between the section 152*a* and 152*b* of the bracket 152, and disposed below the brake support block 148, is a pivot block 176 attached to the sections 152*a* and 152*b* by pins 178. An adjusting screw 180 extends into an insert 182 in the brake support block 148, for purposes to be described hereinafter.

The detailed view of FIG. 10, taken in conjunction with the overall view of FIG. 1 insofar as the latter relates to the brake assembly, illustrates the principles of operation of the brake assembly. In FIG. 10, as in FIG. 1, the section 100*a* of the pedal support arm 100 and the section 152*a* of the bracket 152 have been removed for purposes of clarity. Furthermore, a portion of the view of FIG. 10 is shown in cross-section. From FIG. 10 it is seen that the pins 164 and 166 are received within cylindrical apertures 184 and 186 respectively, formed in the brake support block 148. A third such aperture 188 is also formed therein, on the opposite side of the aperture 186 from the aperture 184.

In FIG. 1, the roller 160 is shown as resting on the side of the pin 166 which is opposite from the pin 164 received within the aperture 184. In this ("unlocked") configuration, the sides of the aperture 174 formed in the brake support block 148 are approximately parallel. The aperture 174 extends from the rear of the block 148 to the apertures in which the brake drums 150*a* and 150*b* are received.

In FIG. 10, the "C" bracket 152 has been tilted by forward pressure on the pedal tread plate 102 (in the direction of the arrow in FIG. 1), pivoting about the pivot block 176, and thus forcing the roller 160 to roll over the pin 166 and to rest on both the pin 166 and the pin 164. In this ("locked") configuration, sufficient pressure is exerted on the brake support block 148, and specifically the portions thereof through which the aperture 174 extends, to squeeze the brake support block 148 in the area of the aperture 174 and thereby frictionally engage the brake support block 148 with the brake drums 150*a* and 150*b* received therein. This action prevents the brake drums 150*a* and 150*b* from turning, and the degree of pressure on the brake support block 148 which is applied to achieve this result is regulated by adjustment of the adjusting screw 180. Further forward movement of the roller 160 with respect to the pin 166 is prevented by the engagement of the roller 160 against the pin 164.

If desired, the pin 164 may be removed from the aperture 184 and reinserted in the aperture 188. In this configuration, the brake support block 148 would be compressed when the pedal tread plate 102 is tilted backward, that is, between the pins 166 and 164, and would be in a state of non-compression when the pedal tread plate 102 is tilted forward, that is, in the position shown in FIG. 10.

Figure 11:
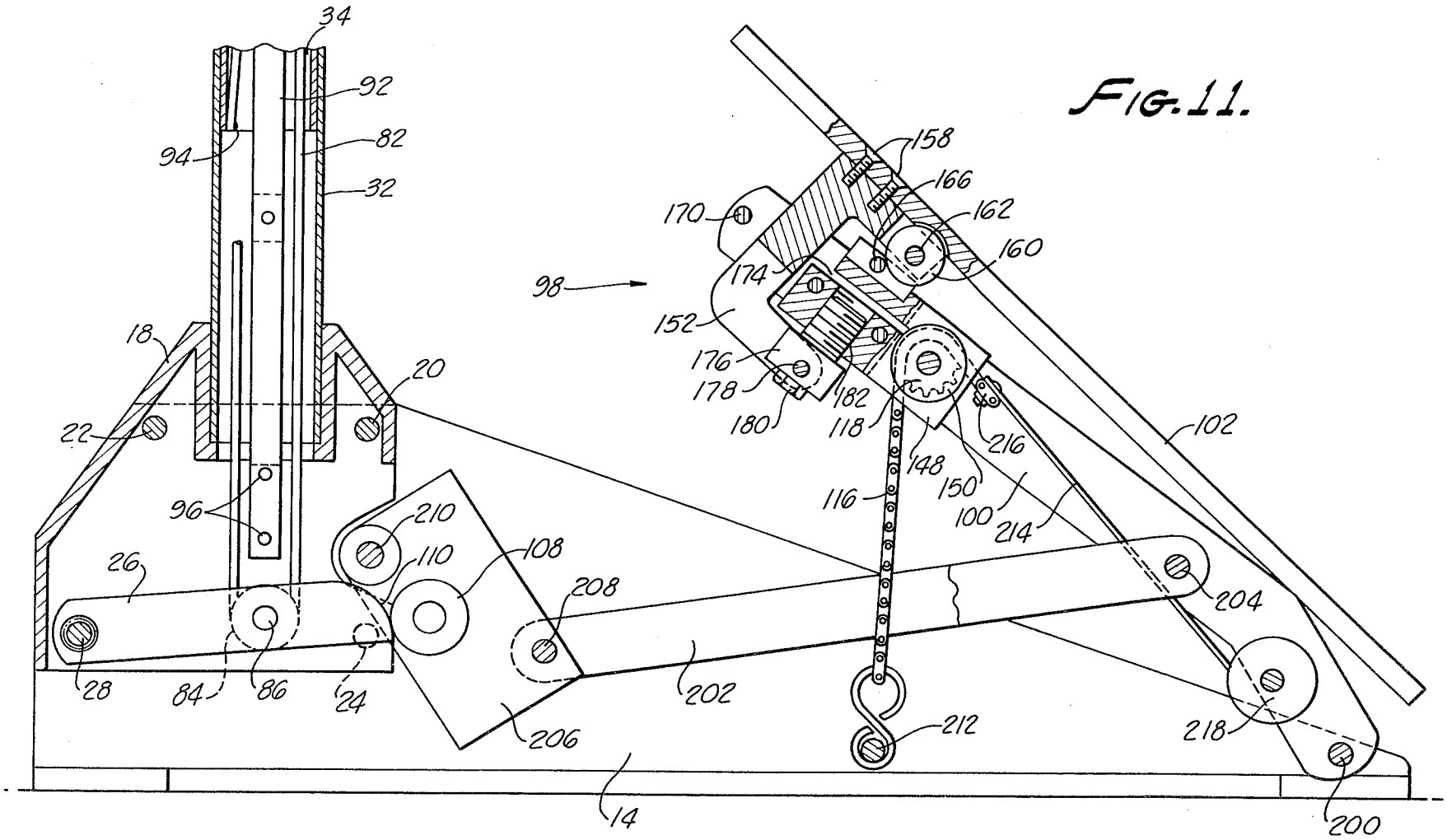
FIG. 11 is a side elevation of an apparatus according to the present invention, showing the apparatus folded for storage and/or transportation.

FIG. 11 illustrates an alternative mounting and design for the pedal assembly 98, in which like reference numerals have been utilized for purposes of clarity to indicate elements identical to or performing the same function as elements of the structure illustrated in FIGS. 1–10. In the configuration of FIG. 11, the pedal support arm 100 is attached to and pivots about a point near the end of the base 14 opposite the end supporting the drum by a pin 200. A linkage arm 202 is connected at one end to the pedal support arm 100 by a pin 204 and at the other end to a toggle arm 206 similar to the toggle arm 106 of FIG. 1, by a pin 208. The toggle arm 206 is pivotally connected to the base 14 by a pin 210, and carries the cam roller 108 which engages the curved cam surface 110 of the toggle linkage arm 26 in a manner similar to that illustrated in FIG. 1.

In the embodiment of FIG. 11, the roller chain 116 is connected to the base 14 by a pin 212, passes over the sprocket 118, and is then connected directly to a coil spring 214 by a fastener 216. The coil spring 214 is tensioned by a take-up reel 218 fastened to the pedal support arm 100 near the end thereof which is connected to the base 14.

At the other end of the pedal support arm 100 there is mounted the brake support block 148 in which is formed the narrow longitudinal aperture 174. The brake drum 150*a* (and another brake drum 150*b*, not shown in FIG. 110 is received in the brake support block 148, as is the insert 182 with its associated adjusting screw 180. The pivot block 176 is attached by the pins 178 to the "C" bracket 152, to the upper side of which is attached the pedal tread plate 102 by the fasteners 158. The "C" bracket 152 also carries the roller 160 which rotates about the axis 162. A single pin 166 is carried by the brake support block 148 for engagement with the roller 160. The pin 170 is affixed to the end of the pedal support arm 100 opposite the end attached to the base 14.

The operation of the device illustrated and described herein will now be understood as follows. The drumhead should first be tightened by rotation or otherwise to a minimum desired tension, thus producing a minimum desired pitch. When the drummer desires to increase the pitch on the drumhead, he depresses the pedal tread plate 102, causing the cam roller 108 to roll upwardly along the curved cam surface 110 of the toggle linkage arm 26. The toggle linkage arm 26 is thereby forced downward, causing the cable 82 to be pulled downward as well because the cable 82 is wound about the pulley 84 which is connected to the toggle linkage arm 26. The downward movement of the cable 82 causes the actuating lever 48 to pivot about the pin 50, forcing the actuating pin 52 upward against the force transfer block 58. The force transfer block 58 in turn transfers the upwardly directed force to the "C" bracket 62, which exerts force against the insert 64 in the central hub 66 of the upper die casting 68, thus increasing the tension on, and the pitch of, the drumhead 70.

In the embodiment of FIGS. 1–10, when the pedal tread plate 102 is depressed the roller chain 116 rolls over the sprockets 118 and 120, and the coil spring 126 causes the excess chain to be taken up on the take-up sprocket 122, thus preventing slack at any point in the chain. The take-up sprocket 122 is dimensioned so that its circumference is slightly greater than the maximum length of excess chain which must be taken up when the pedal tread plate 102 is fully depressed. In the embodiment of FIG. 11, the roller chain 116 rolls over the single sprocket 118 and slack is taken up directly by the coil spring 126. Of course, such an arrangement could be utilized in the embodiment of FIGS. 1–10 also.

When it is desired to fix the tension and thus the pitch of the drum at any selected position in the embodiment of FIGS. 1–10, the operator simply tilts the pedal tread plate 102 so that the roller 160 rolls over the pin 166 and is supported between the pins 164 and 166. As previously described in connection with FIG. 10, this action will compress the brake support block 148 sufficiently to lock the brake drums 150*a* and 150*b* received therein, thus preventing the sprocket 118 from rotating. Since the sprocket 118 cannot rotate, the chain 116 engaged therewith maintains the selected locked position of the pedal tread plate 102. The pedal tread plate 102 may be further depressed, in which event slack will appear in the chain 116 between the sprocket 118 and the point of attachment of the chain 116 to the base 14, but when the pressure on the pedal tread plate 102 is released, the pedal tread plate 102 will return to its locked position. The brake drums 150*a* and 150*b* may be unlocked simply by pivoting the pedal tread plate 102 in the opposite direction to that utilized in locking the brake drums, thus disengaging the roller 160 from the pins 164 and 166 and again permitting the brake drums 150*a* and 150*b* to rotate freely. The pins 170 serve as a stop for the roller 160 in the unlocked position by engaging the sides of the apertures 168 and thus limiting the degree to which the pedal tread plate 102 may be pivoted. When the pedal tread plate 102 is not in a locked position and is not depressed by the drummer, the pedal return spring 112 urges the pedal tread plate 102 upward to its normal resting position as shown in FIG. 1. The drumhead tension in the embodiment of FIG. 11 may be fixed in a similar manner, by tilting the pedal tread plate 102 so that the roller 160 rolls over the single pin 166, thereby compressing the brake support block 148 and locking the brake drums. Engagement of the pin 170 with the edge of the "C" bracket 152 prevents further movement of the pedal tread plate 102 in the locked direction. The brake drums are unlocked by pivoting the pedal tread plate 102 in the opposite direction, and further movement of the pedal tread plate in the unlocked direction is limited by the engagement of the underside of the pedal tread plate with the pedal support arm 100. No pedal return spring is necessary in the embodiment of FIG. 11.

At any time during operation of the RotoTom drum while mounted on the stand assembly described herein, whether or not the drumhead is tensioned by use of the pedal assembly, the tension may still be adjusted by rotation of the drum about its axis in the normal manner. Thus, for example, an approximate pitch may be achieved by locking the position of the pedal tread plate, and then fine tuning may be accomplished by rotating the drum.

Also, as previously indicated, the angle of the drum can be varied by operation of the ratchet 42. Because the height of the point of attachment of the cable 82 to the activating lever 48 will vary somewhat when the drum is tilted at an angle, the cable 82 may become overly tensioned or relaxed depending upon the direction toward which the drum is tilted. Too great or too little a range of drumhead tensions may result. Therefore, the use of compensating means (not shown in the drawings) may be desirable to maintain a relatively constant range of drumhead tensions. For example, such means may include a roller mounted in the upper end of the upper support column 34 and adapted to engage the cable 82, and a stop sleeve affixed to the cable 82 below the roller and adapted to be engaged by the roller to limit the upward movement of the cable 82. A longitudinal slot may also be formed in the support block 46 between the apertures thereof in which the arms 42*c* and 42*d* are received, to permit greater angular movement of the actuating lever 48. The position of the stop sleeve may be chosen so as to engage the roller when the drum is tilted to a point of maximum tension on the cable, to provide a full range of drumhead tensions in this configuration. When the drum is tilted in the opposite direction, i.e., so that the tension on the cable 82 is taken up by allowing the actuating lever to pivot into the slot formed in the support block 46. Some of this slack is also taken up by the engagement of the cable 82 with the roller mounted in the upper end of the upper support column 34. Thus, the full range of drumhead tensions is available regardless of the angle at which the drum is tilted.

In addition, the height of the drum above the floor or other surface on which the stand is mounted can be varied simply by loosening the bolts 38 and sliding the upper support column 34 within the lower support column 32. Because of the cable-pulley arrangement utilized herein, the length of the cable 82 will not need to be adjusted in order to make this height adjustment. Because the cable 82 is effectively attached at both ends of the upper support column 34, this arrangement also substantially relieves the downward force on the upper support column 34 that would otherwise be exerted by tensioning the cable, so that only a light clamp 36 is needed to maintain the selected drum height.

For transportation or storage, the drum is easily removable from the drum stand assembly by removing the pin 56 from the guide stud 54, thus permitting the guide stud 54 to be removed from the mounting block 46. The drum stand assembly may further be folded for storage or transportation as shown in FIG. 12. The legs 16 may be folded parallel to the sides of the base 14 as described in connection with FIG. 7, and the pedal fully depressed and then placed in its locked position as previously described. The removable pin 22 is then removed from the base 14 and the support block 18, permitting the latter to pivot approximately 90° about the pin 20. This movement aligns the aperture 24 in the support block 18 with the aperture in the base 14 from which the pin 22 was removed, permitting the pin 22 to be reinserted therethrough and through the aperture 24, thus locking the support block 18 in the folded position.

While the present invention has been illustrated and described with respect to a presently preferred embodiment thereof, many variations and modifications of the concepts disclosed herein will be apparent to those skilled in the art, and it is intended that all such variations and modifications be encompassed within the scope of the appended claims.

I claim:

1. Actuating apparatus for adjustable pitch drums comprising a foot pedal, a support stand, a support rod carried by said support stand and adapted to support a drum, a pivoted lever arm mounted on said support stand, a push rod engaged with said pivoted lever arm and adapted to be pushed upward thereby, a "C" shaped bracket having arms slideably received on said support rod, said bracket resting upon said push rod and adapted to engage drumhead tensioning means associated with said drum, and means connected to said pivoted lever arm and actuated by said foot pedal for pivoting said lever arm against said push rod upon depression of said foot pedal, thereby urging said "C" shaped bracket against said drumhead tensioning means to tension the drumhead of said drum.

2. Apparatus as in claim 1 wherein said support stand comprises a telescoping rod assembly having a plurality of hollow support columns slideably engaged together.

3. Apparatus as in claim 2 wherein said means for pivoting said lever arm comprises a wire cable connected to said lever arm opposite the point of engagement of said lever arm with said push rod, said wire cable being wound about a first pulley connected to a pivoted toggle arm actuated by said foot pedal and about a second pulley support within said telescoping rod assembly and being connected to the uppermost of said hollow support columns at its end opposite the point of connection to said pivoted lever arm.

4. Apparatus as in claim 3 wherein said toggle arm comprises a curved cam surface with which a cam roller connected to said foot pedal is engaged for pivoting said toggle arm downward upon depression of said foot pedal and thereby causing said wire cable to exert force on said pivoted lever arm.

5. Apparatus as in claim 1 wherein said foot pedal is carried by a pedal support arm pivotally connected to said support stand.

6. Apparatus as in claim 5 further including a sprocket mounted on said pedal support arm and a roller chain engaged with the teeth of said sprocket, said roller chain being affixed at one end to said support stand and at the other end to take-up means, and brake means for locking said sprocket to prevent rotation thereof, whereby activation of said brake means causes said apparatus to maintain a fixed degree of tension upon said drumhead.

7. Apparatus as in claim 6 wherein said brake means comprises a compressible block having a brake drum received therein, said brake drum being mounted coaxially with said sprocket, and means for compressing said block to lock said brake drum against rotation therein, whereby said sprocket is also locked against rotation.

8. Apparatus for adjusting the pitch of a drum, comprising a tensioning ring disposed against the underside of the drumhead of said drum and having arms connected to a substantially central hub, a support rod abutting the underside of said hub, a "C" shaped bracket slideably engaged with said support rod and adapted to abut the underside of said hub, means for transferring upwardly directed force to said bracket, and pedal actuated means for exerting a selected degree of force on said force transferring means to vary the pitch of said drum.

9. Apparatus as in claim 8 further including means for locking said pedal actuated means to maintain a fixed degree of force on said drumhead.

10. Apparatus as in claim 8 further including a support stand comprising a plurality of hollow telescoping columns for adjustment of the height of said drum.

11. Apparatus as in claim 8 wherein said pedal actuated means comprises a cable connected at one end to a pivoted actuating lever and at the other end to a pivoted linkage arm, said actuating lever being adapted to exert force on said force transferring means.

12. Apparatus as in claim 11 wherein said pedal actuated means further comprises a cam roller connected to a pedal, said cam roller being engaged with a curved cam surface of said linkage arm to pivot said linkage arm downard upon depression of said pedal.

13. An adjustable height stand for musical drums whose pitch is adjustable by pedal actuation, comprising a plurality of hollow telescoping column members, and a wire cable connected at one end to drumhead tensioning means carried by the uppermost of said members and received within said members, said cable being wound about a first pulley connected to a toggle arm mounted on said stand and about a second pulley supported within said members and being connected at its other end to the inner surface of said uppermost member, whereby the height of said stand is adjustable by telescoping said column members without varying the length of said wire cable.

14. A brake apparatus for locking the pedal of a pedal adjustable drum to maintain a selected pitch thereof, comprising a compressible block having a brake drum received therein, a toothed sprocket mounted coaxially with said brake drum, a roller chain engaged with said sprocket and having one end affixed to the base of a stand for supporting said drum, and means for compressing said block to lock said brake drum therein by friction and thereby prevent rotation of said sprocket.

15. Apparatus as in claim 14 wherein said means for compressing said block comprises a "C" shaped bracket having a pivot point disposed below said block and supporting a pedal tread plate above said block, and having a roller disposed between said block and said pedal tread plate and adapted to engage at least one pin supported above said block, and wherein said block comprises a narrow longitudinal aperture extending from one end thereof into the aperture in which said brake drum is received, whereby said brake drum is adapted to be locked by friction in said block by pivoting said pedal tread plate so that said roller engages said pin and said longitudinal aperture is thereby compressed.

16. Actuating apparatus for adjustable pitch drums, comprising a base, a telescoping rod assembly supported by said base, upper and lower pulley means, said upper pulley means being supported within said telescoping rod assembly by an arm attached to said base, and said lower pulley means being mounted on a pivoted toggle arm attached at one end to said base and having a curved cam surface at its other end, a wire cable attached at one end to the inside rod of said telescoping rod assembly, said wire cable being wound around said uppr pulley means and said lower pulley means being attached at its other end to a lever mounted upon the upper end of said inside rod of said telescoping rod assembly, said lever being adapted to engage drumhead tensioning means, and pedal means for actuating said lever, said pedal means comprising a pedal support arm pivotally connected to said base, said arm having a roller actuably engaged therewith for engaging said curved cam surface of said pivoted toggle arm and thereby exerting a downward force on said cable when said pedal is depressed, whereby said lever is adapted to pivot when said pedal is depressed to urge said lever against drumhead tensioning means engaged therewith.

17. Apparatus as in claim 16 further comprising a pedal lock mechanism for maintaining any selected drumhead tension by locking said pedal means at any selected position, said mechanism comprising a roller chain fastened at one end to said base, passing over a sprocket attached to said pedal support arm, and connected to take-up means said take-up means being tensioned to take up slack in said roller chain, and brake means for locking said sprocket into any selected position, whereby activation of said brake means locks the position of said pedal and said take-up means eliminates slack in said roller chain.

18. Apparatus as in claim 16 further comprising drumhead tensioning means activated by said lever, said drumhead tensioning means comprising a push rod engaged with said lever and adapted to be urged upward thereby to tension a drumhead upon actuation of said lever by depression of said pedal means.

19. Apparatus as in claim 18 wherein said drumhead tensioning means further comprises a tensioning ring over which a drumhead may be stretched, said tensioning ring having arms connected to a substantially central hub and said push rod abutting the underside of said hub.

20. Actuating apparatus for adjustable pitch drums comprising a base, a support stand mounted on said base for supporting a drum, a pivoted lever arm mounted on said support stand, a push rod engaged with said pivoted lever arm and adapted to engage drumhead tensioning means, a pedal for actuating said lever arm, said pedal being pivotally connected to said base by a pedal support arm, and a pedal lock mechanism for maintaining any selected drumhead tension by locking said pedal at any selected position, said mechanism comprising a roller chain fastened at one end to said base, passing over a sprocket attached to said pedal support arm, and connected to take-up means, said take-up means being tensioned to take up slack in said roller chain, and brake means for locking said sprocket into any selected position, whereby activation of said brake means locks the position of said pedal and said take-up means eliminates slack in said roller chain.

21. Apparatus as in claim 20 wherein said brake means comprises a compressible block having a brake drum received therein, said brake drum being mounted coaxially with said sprocket, and means for compressing said block to lock said brake drum therein by friction and thereby prevent rotation of said sprocket.

22. Apparatus as in claim 21 wherein said means for compressing said block comprises a "C" shaped bracket having a pivot point disposed below said block and supporting a pedal tread plate above said block, and having a roller disposed between said block and said pedal tread plate and adapted to engage at least one pin supported above said block, and wherein said block comprises a narrow longitudinal aperture extending from one end thereof into the aperture in which said brake drum is received, whereby said brake drum is adapted to be locked by friction in said block by pivoting said tread plate so that said roller engages said pin and said longitudinal aperture is thereby compressed.

23. A stand and actuating device for adjustable pitch drums comprising a base, a telescoping rod assembly supported by said base and comprising a plurality of telescoping column sections, a holder mounted on said telescoping rod assembly and adapted to hold a drum, said holder including a bracket supporting a guide stud, means for varying the pitch of a drum mounted on said holder, said means comprising a pedal assembly including a pedal tread plate mounted on a pedal support arm pivotally engaged with said base, a roller actuably engaged with to said pedal support arm, linkage arm pivotally engaged with said base and having a curved cam surface for engagement with said roller, upper and lower pulley means, said upper pulley means being supported within said telescoping rod assembly by a support member mounted on said base and said lower pulley means being connected to said linkage arm, a wire cable connected at one end to the bottom of the uppermost of said telescoping column sections and therefrom being disposed around said upper pulley means and said lower pulley means and being attached at its other end to an actuating lever pivotally engaged with said bracket supporting said guide stud, an actuating pin slideably engaged with said holder and adapted to be actuated by pivotal movement of said actuating lever, a force transfer block connected to said actuating pin and slideably engaged with said guide stud, and a "C" shaped bracket supported by said force transfer block and slideably engaged with said guide stud, said bracket being adapted to exert force against a drumhead tensioning assembly of a drum mounted on said holder, and means for locking said pedal assembly in a selected position to maintain a constant selected pitch of said drum, including sprocket means mounted on said pedal support arm, take-up means, a roller chain connected at one end to said base, passing over and engaging the teeth of said sprocket means and connected at its other end to said take-up means, and brake means for locking said sprocket means to prevent rotation thereof and thereby prevent movement of said roller chain engaging the teeth thereof.

* * * * *